US007030305B1

(12) United States Patent
Cupid

(10) Patent No.: US 7,030,305 B1
(45) Date of Patent: Apr. 18, 2006

(54) ELECTRONIC SYNTHESIZED STEELPAN DRUM

(76) Inventor: Salmon Cupid, 57 Harrongate Place, Whitby, On (CA) L1R 3E5

( * ) Notice: Subject to any disclaimer, the term of this patent is extended or adjusted under 35 U.S.C. 154(b) by 156 days.

(21) Appl. No.: 10/774,256

(22) Filed: Feb. 6, 2004

(51) Int. Cl.
*G10D 13/02* (2006.01)

(52) U.S. Cl. ..... 84/411 R; 84/402; 84/411 P; 84/723; 84/738; 984/365

(58) Field of Classification Search ..... 84/723, 84/402, 421, 411 R, 411 P, DIG. 22, DIG. 24, 84/DIG. 12, DIG. 1, 743, 741, 732, 613, 84/637, 645, 730; 984/365, DIG. 1
See application file for complete search history.

(56) References Cited

U.S. PATENT DOCUMENTS

| | | | | | |
|---|---|---|---|---|---|
| 319,650 | A | | 6/1885 | Hart | |
| 4,479,412 | A | * | 10/1984 | Klynas | 84/730 |
| 4,679,479 | A | | 7/1987 | Koyamato | |
| 4,700,602 | A | | 10/1987 | Bozzio | |
| 5,115,706 | A | * | 5/1992 | Aluisi | 84/723 |
| 5,502,274 | A | | 3/1996 | Hotz | |
| 5,856,628 | A | * | 1/1999 | Noguchi et al. | 84/738 |
| 5,973,247 | A | * | 10/1999 | Matthews | 84/402 |
| 6,212,772 | B1 | | 4/2001 | Whitmyre | |

* cited by examiner

*Primary Examiner*—David Martin
*Assistant Examiner*—Christina Russell

(57) ABSTRACT

An electronic synthesized steelpan drum resembling a conventional steelpan drum and featuring the same shallow cylindrical shape with a sunken concave playing surface. The steelpan drum includes a central processor chip and associated memory chips for providing a variety of synthesized steelpan and a full range of musical, orchestral, and symphonic instrumental sounds, including tenor, double-seconds, guitar, cello, quadraphonic, tenor-bass, and bass steel drums. The concave playing surface is comprised of a series of rubber striking pad areas, which can be arranged in a conventional or other unique pattern typical of a tenor pan. The striking pad areas will be played with a pair of pan-sticks. Attached under each pad is a pressure sensor, which will detect the amount of force applied when a pannist strikes a pad and provide a signal to the central processor for controlling the synthesized sound. The steelpan has various control functions including speakers, volume control, function selection buttons, and a control display panel.

18 Claims, 3 Drawing Sheets

ELECTRONIC SYNTHESIZED STEELPAN DRUM

BACKGROUND OF THE INVENTION

1. Field of the Invention

The present invention relates to an electronic version of a steelpan drum. The electronic synthesized steelpan drum has particular utility in connection with delivering the true and natural sounds and tones of a steelpan drum, as well as eliminating the need for continuous repetitive tuning of the instrument.

2. Description of the Prior Art

Electronic steelpan drums that can deliver true and natural sounds of a variety of different steelpan instruments and that does not require the need for a tuning expert to continuously keep the instrument tuned for optimized sound is very desirable.

The use of electron drums is known in the prior art. For example, U.S. Pat. No. 4,700,602 to Bozzio discloses an electronic drum having multiple sound sources with rapidly detachable striking elements and piezoelectric transducers. However, the Bozzio '602 patent is different in structure from the present invention and does not use electronic synthesizers to deliver the natural sound of a steelpan drum. Furthermore, this patent does not disclose the mixing of other musical instruments with the sound of the steelpan drum.

U.S. Pat. No. 4,679,479 to Koyamato discloses an electronic drum, which uses a single detection element mounted on the base layer of the drum to detect the striking of the drum surface. However, the Koyamato '479 patent is different in structure from the present invention and does not use electronic synthesizers to deliver the natural sound of a steelpan drum. Furthermore, this patent does not disclose the mixing of other musical instruments with the sound of the steelpan drum.

Also, U.S. Patent Design No. D319,650 to Hart discloses the design of an electronic drum. However, the Hart '650 patent is also different in structure from the present invention in that it has a single striking surface and does not use electronic synthesizers to deliver the natural sound of a steelpan drum. Furthermore, this patent does not disclose the mixing of other musical instruments with the sound of the steelpan drum.

Lastly, U.S. Pat. No. 5,502,274 to Hotz, U.S. Pat. No. 6,212,772 to Whitmyre et al., and U.S. Pat. No. 5,973,247 to Matthews disclose apparatus that may be of general interest and pertinent to the construction and design of the present invention. The Hotz '274 patent discloses an electronic musical instrument for playing along with prerecorded music. However, this instrument is different in structure from the present steelpan instrument patent and does not concentrate on generating the true and natural sound of steelpan drum. The Whitmyre '772 patent discloses a Caribbean steelpan drum. However, this instrument is also different in structure from the present invention and does not disclose an electronic version of the drum. Finally, the Matthews '247 patent discloses a portable steel drum and carrier. Here again, this instrument is different in structure from the present invention and does not disclose an electronic version of the drum.

While the above-described devices fulfill their respective, particular objectives and requirements, the aforementioned patents do not describe an electronic synthesized steelpan drum that delivers true and natural steelpan sound.

Therefore, a need exists for a new and improved electronic synthesized steelpan drum that can deliver the true and pure sounds of the steelpan drum, doesn't require the laborious setup and continuous tuning that the traditional steelpan drums require, and can be mixed with other musical instruments inside the instrument. In this regard, the present invention substantially fulfills this need. In this respect, the electronic synthesized steelpan drum according to the present invention substantially departs from the conventional concepts and designs of the prior art, and in doing so provides an apparatus primarily developed for the purpose of providing pure steelpan drum sounds from an electronic instrument.

SUMMARY OF THE INVENTION

In view of the foregoing disadvantages inherent in the known types of synthesized drums now present in the prior art, the present invention provides an electronic synthesized steelpan drum, and overcomes the above-mentioned disadvantages and drawbacks of the prior art. As such, the general purpose of the present invention, which will be described subsequently in greater detail, is to provide a new and improved steelpan drum that has all the advantages of the prior art mentioned heretofore and many novel features that result in a steelpan that is not anticipated, rendered obvious, suggested, or even implied by the prior art, either alone or in any combination thereof.

To attain this, the present invention essentially comprises an electronic synthesized version of the steelpan drum. The instrument will resemble a conventional steelpan drum, featuring the same circular or shallow cylindrical shape with a sunken concave playing surface. The steelpan can be made thinner in height since the sound is generated electronically, thereby making the instrument lighter and easier to handle, although some designs may maintain the conventional height for aesthetics purposes.

The electronic steelpan drum will include a central processor chip and associated memory chips for providing a variety of synthesized steelpan sounds or tones, including tenor, double-seconds, guitar, cello, quadraphonic, tenor-bass, and bass steel drums. Musical instrument digital interface (MIDI) ports are also included on the unit to allow it to interface with other electronic or digital instruments and sound modules. It is also likely that an output jack would be included for connecting the steelpan to an external audio amplifier.

The concave playing surface of the steelpan will have a series of rubber pad striking areas, which can be arranged in a conventional or other unique pattern. One example, typical of a tenor-pan steel drum will have an outer ring of twelve larger pads around the perimeter of the playing surface, an intermediate ring of twelve additional medium-sized pads, and four small pads located at the center of the playing surface. Generally, the larger area pads are associated with lower frequency musical notes and the smaller pads with higher frequency notes. Attached under each pad is a pressure sensor, which will detect the amount of force applied when a pannist strikes a pad and provide a signal to the central processor for controlling the synthesized sound.

The circular shape of the steelpan will typically be extended elliptically in one direction to provide surface space for various control functions on the instrument. These functions include speakers, volume control, function selection buttons, and a control display panel. Optionally, a compact disk (CD) port can be added to the unit for loading additional digitized sounds of rhythms and samples for playing and recording music from the instrument.

In use, the pannist will select the desired synthesized sound effect using the control buttons and display panel, choosing one from the available sound variety list. He/she can also configure the pads to represent a desired pattern. Typically, steelpans require setup and more or less continuous tuning by an expert in order to generate the pure and unique sounds that are possible from this instrument. However, the electronic synthesized steelpan of the present invention requires much less setup and tuning time, thereby allowing the player to concentrate his/her attention to the music.

The electronic synthesized steelpan of the present invention will electronically capture the unique and distinct "ping and ring" sound that comes from traditional steelpan instruments. This is achieved through advanced digital recording and storage within the built-in electronic chips, which allows the pannist to play music with full and easy control over the basic elements of tone, rhythm, melody, harmony, tone color, and equalized volume. This can be carried out with the pannist playing the instrument in the traditional way that steelpans are played the world over.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new electronic synthesized steelpan drum that provides in the apparatuses and methods of the prior art some of the advantages thereof, while simultaneously overcoming some of the disadvantages normally associated therewith.

It is another object of the present invention to provide a new and improved electronic synthesized steelpan drum that may be easily and efficiently manufactured and marketed.

An even further object of the present invention is to provide a new and improved electronic synthesized steelpan drum that has a low cost of manufacture with regard to both materials and labor, and which accordingly is then susceptible of low prices of sale to the consuming public, thereby making such instruments economically available to the buying public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
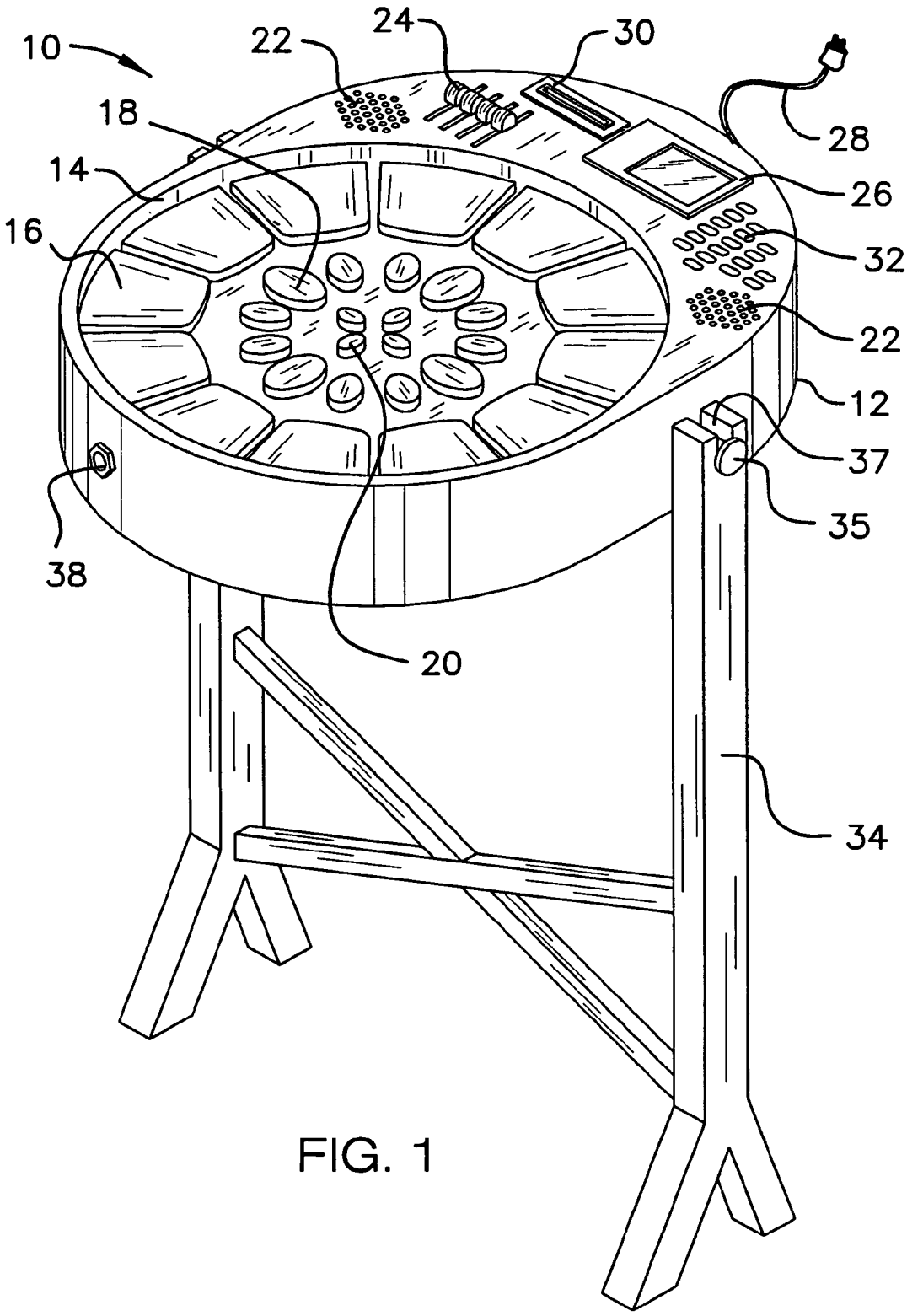
FIG. 1 is a perspective top view of the preferred embodiment of the steelpan drum and accompanying free-standing pan stand constructed in accordance with the principles of the present invention.
Figure 2:
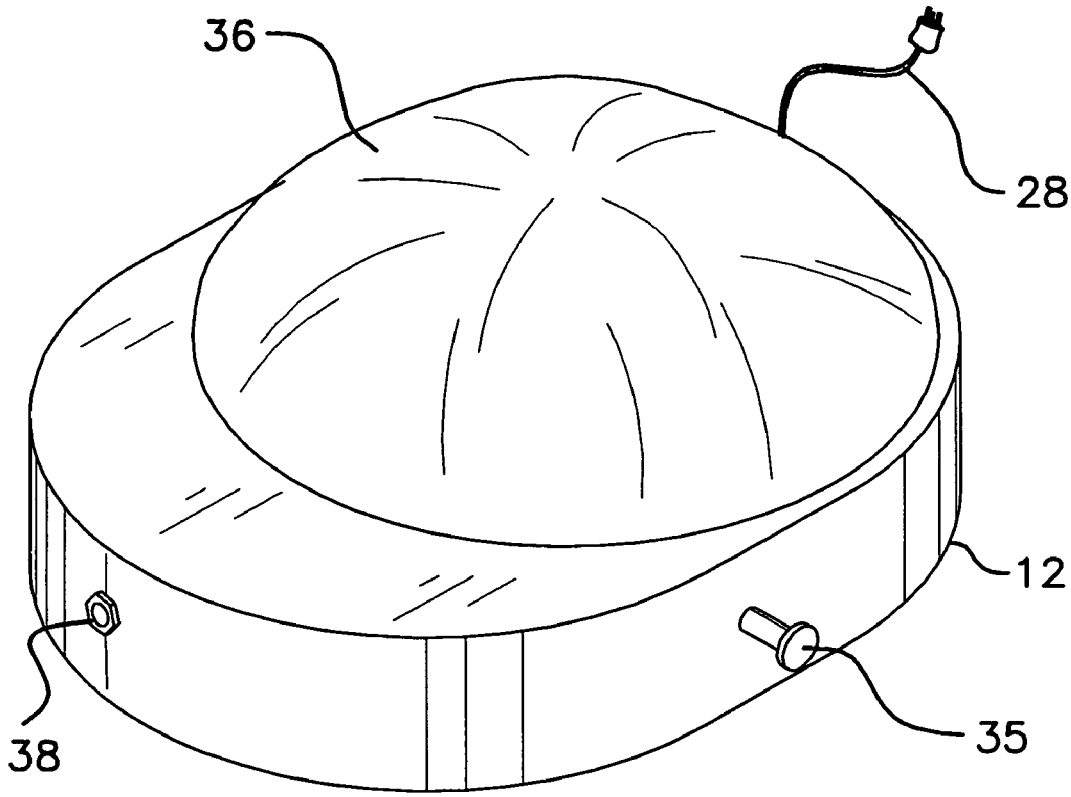
FIG. 2 is a perspective side view of the steelpan drum of the present invention.
Figure 3:
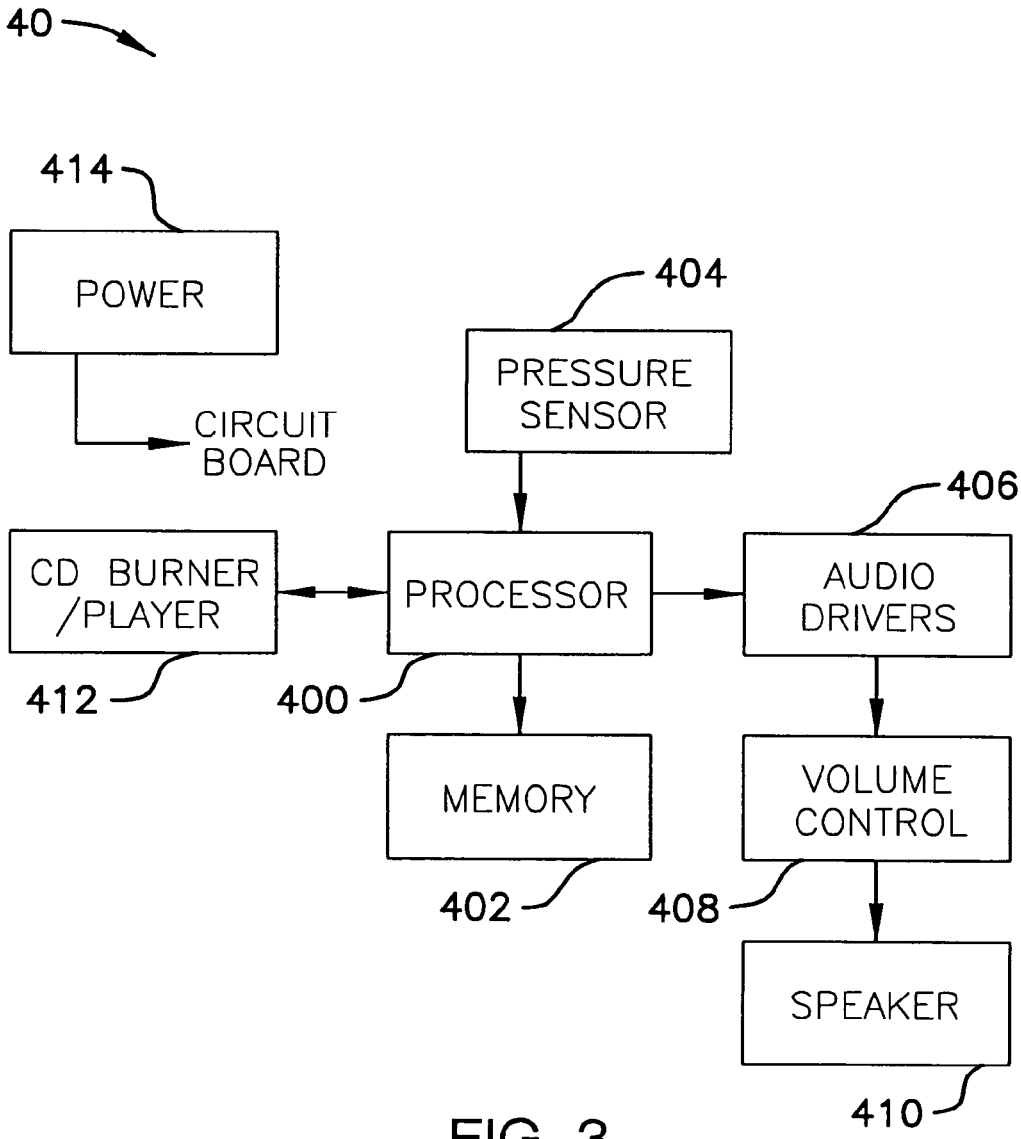
FIG. 3 is a block diagram for the electronics used in the synthesizing the steelpan drum of the present invention.

Referring now to the drawings, and particularly to FIGS. 1–3, a preferred embodiment of the electronic synthesized steelpan drum of the present invention is shown and generally designated by the reference numeral 10.

In FIGS. 1 and 2, a new electronic synthesized steelpan drum 10 of the present invention for producing true and pure steelpan tones is illustrated and will be described. More particularly, the electronic synthesized steelpan drum 10 is comprised of an outer housing 12 with a convex back surface 36 that has a stretched-cylindrical (oval) shaped top playing surface with a shallow vertical wall (skirt). In the current embodiment the outer housing 12 is comprised of a lightweight material such as metal, wood or molded plastic. Additionally, pansticks are supplied for striking the drum pads. In the present embodiment, the supplied pansticks are made of a hard rubber material, but conventional wood drumsticks may also be employed.

In this example, which is typical of a tenor steelpan, the top surface of the steelpan has a circular concave playing surface 14 towards one side with raised control functions located on the other side of oval shaped top surface. Approximately twelve striking pads 16 are arranged in a ring near the outer perimeter of the playing surface. When the surface of one of these striking pads 16 is struck with a panstick, typically a lower frequency tone is produced. Additionally, there are typically twelve medium-sized rubber striking pads 18 arranged in a ring inside the outer ring, used to produce mid-frequency tones. Finally, four or more small rubber striking pads 20 are arranged in the center portion of the playing surface for producing higher-frequency tones. A pressure sensor is attached under each pad with the sensor outputs being connected to inputs of a central processor chip mounted on a circuit board inside the outer housing 12. Associated memory chips for storing a variety of synthesized steelpan sounds or tones, including tenor, double tenor, soprano, double-seconds, guitar, double guitar, triple guitar, four-pan, cello, quadraphonic, tenor-bass, bass steel drums, six bass, nine bass, twelve bass and a full range of other musical orchestral and symphonic sounds are included on the circuit board and coupled to the central processor chip; function selection buttons 32 allow for the selection of the sound type and for user configuration of the striking pads. When one of the pads is struck, an appropriate synthesized sound is produced and amplified through one or more speakers 22 included on the top surface of the instrument. The overall volume of the sound is controlled with equalized volume control buttons 24, also mounted in the control function area of the instrument, with the volume of each tone being further controlled by the amount of force applied to the pad and picked up by the pressure sensor. A control display monitor 26 and function selection buttons 32 are used to select different steelpan types and to configure the pads according to the layout of different steel pan instruments. Also, a compact disk (CD) burner/player input port/slot 30 can be added to the unit for loading additional digitized sounds, such as samples of different rhythms, and playing and recording music from the instrument for mixing with the steelpan sound. Optionally, musical instrument digital interface (MIDI) ports are included on the unit to allow it to interface with other electronic or digital instruments and sound modules, as well. An output jack 38 is also be included for connecting the steelpan to an external audio amplifier for outdoor and/or large theater-type venues. The instrument has an electrical power cord 28 that plugs into a 110-volt AC receptacle for electrical power. Finally, a free-standing pan stand 34 will accompany the steelpan drum for both functional and aesthetic purposes. The steelpan drum outer housing 12 will have a mounting means 35 attached to the sides, which will slide into slots 37 at the top of the free-standing pan stand 34, thereby allowing the electronic synthesized steelpan to be hung on a pan stand in a conventional manner.

FIG. 3 is a block diagram 40 for the electronics used in synthesizing the steelpan drum of the present invention. The circuitry is contained on a circuit board that is mounted inside the instrument. At the center of this circuitry is the central processor 400 with its associated memory 402, which stores the digital data for the synthesized sounds. Also, the pressure sensors 404 that are associated with the pads are coupled to inputs of the central processing chip. The output of the circuit is provided through audio drivers 406 and volume control circuitry 408 to one or more speakers 410 mounted on the outer surface of the synthesized steelpan drum 10. A CD burner/player 412 capability is provided for inputting other digital sounds for mixing with the steelpan sound and for recording music from the instrument. Finally, a power supply 414 is included to supply a low voltage DC voltage to the circuit board from a 110-volt AC source. It can now be understood that the electronic synthesized steelpan of the present invention will electronically capture the unique and distinct "ping and ring" sound that comes from traditional steelpan instruments. This is achieved through advanced digital recording and storage within the built-in electronic chips, which allows the pannist to play music with full and easy control over the basic elements of sound type, tone, rhythm, melody, harmony, tone color, and equalized volume, as well as control of the configuration of the sound pads. This can be carried out with the pannist playing the instrument in the traditional way that steelpans are played the world over. And since the electronic synthesized steelpan of the present invention requires much less setup and tuning time, the pannist can spend most of his/her time concentrating on the music.

While a preferred embodiment of the electronic synthesized steelpan drum has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any number of other desired sounds can be synthesized and added to the memory chips for providing other unique steelpan sounds. Also, the housing of the steelpan drum may be made of lightweight metal, wood, molded plastic, or other similar material of similar weight and density.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An electronic steelpan drum, comprising:

an oval can-like outer housing with extended control function surface along one side, said outer housing having a top circular sunken concave playing surface, the height of said outer housing being of varying lengths for aesthetic purposes;

a plurality of striking pads arranged on said concave playing surface, the area of said striking pads generally associated with the frequency range of the generated musical notes;

pressure sensors attached to the bottom side of each said striking pad for determining the force applied to said striking pad by a pannist;

a central processing chip mounted on a circuit board enclosed within said outer housing for electronically controlling the functions of said steelpan drum;

one or more memory chips mounted on said circuit board and coupled to said central processing chip for storing a variety of synthesized steelpan sounds and a full range of musical, orchestral, and symphonic sounds to be reproduced by said steelpan drum;

a plurality of function selection buttons mounted on said control function surface along one side of said outer housing for selecting one of said variety of synthesized steelpan sounds;

audio drivers mounted on said circuit board, the input of said audio drivers coupled to an audio output of said central processing chip;

volume control equalizing circuitry coupled to the output of said audio drivers;

one or more speakers mounted on said outer housing, said speakers driven from said audio drivers;

a display mounted on said outer housing for use in plug-and-play setup and controlling the basic elements of said steelpan drum; and a power supply for providing DC power to said circuit board of said steelpan drum, said power supply being sourced from a 110-volt AC outlet.

2. The steelpan drum of claim 1, said plurality of striking pads being further comprised of:

an outer ring of larger striking pads generally associated with lower frequency sounds;

a central ring of medium sized striking pads generally associated with mid-range frequency sounds; and a central patch of at least four small striking pads generally associate with higher frequency sounds, which will be played with a pair of pansticks.

3. The steelpan drum of claim 1, wherein said outer housing has a convex bottom surface.

4. The steelpan drum of claim 1, wherein a free-standing pan stand is used to hold said steelpan drum, said free-standing stand having a slot means for receiving said steelpan drum.

5. The steelpan drum of claim 4, said outer housing further comprising an attaching means for hanging said steelpan drum on said free-standing pan stand.

6. The steelpan drum of claim 1, wherein said synthesized steelpan sounds are configurable from the group consisting of: tenor, double-seconds, guitar, cello, quadraphonic, tenor-base, and base.

7. The steelpan drum of claim 1, wherein said basic elements of said steelpan drum are selected from the group consisting of: sound type, configuration of striking pads, tone, rhythm, melody, harmony, tone color, and equalized volume.

8. The steelpan drum of claim 1, wherein said outer housing is constructed with materials from the group consisting of: molded plastic, lightweight metal, and wood.

9. The steelpan drum of claim 1, wherein said striking pads are made of hard rubber-type material.

10. The steelpan drum of claim 2, wherein said pansticks are made of hard rubber-type material.

11. The steelpan drum of claim 1, wherein a musical instrument digital interface (MIDI) is provided for interfacing said steelpan drum with other musical instruments.

12. The steelpan drum of claim 1, wherein said steelpan drum has an audio output jack mounted on said outer housing for coupling to an external audio amplifier.

13. The steelpan drum of claim 1, wherein a CD player/burner port is included on said housing and coupled to said central processing chip for mixing other musical, orchestral, and symphonic instrumental samples with the steelpan drum sound and for recording the output from said steelpan drum.

14. The steelpan drum of claim 1, wherein a series of equalizing volume control buttons are mounted on said outer housing for quick equalization of the sound from said steelpan drum by a musician.

15. The steelpan drum of claim 1, wherein said synthesized steelpan sounds are from the group consisting of: tenor (soprano), double tenor, double seconds, double guitar, triple guitar, four-pan (cello), quadraphonic, tenor bass, six bass, nine bass, and twelve bass.

16. An electronic steelpan drum with mixing capability, comprising:

an oval can-like outer housing with extended control function surface along one side, said outer housing having a top circular sunken concave playing surface, said outer housing having a convex back surface, the height of said outer housing being of varying lengths for aesthetic purposes, said outer housing further having an attaching means for hanging said steelpan drum on a pan stand;

a plurality of rubber striking pads arranged on said concave playing surface, said striking pads further comprising:

an outer ring of larger striking pads generally associated with lower frequency sounds;

a central ring of medium sized striking pads generally associated with mid-range frequency sounds; and a central patch of at least four small striking pads generally associate with higher frequency sounds, which are played with a pair of pansticks;

pressure sensors attached to the bottom side of each said striking pad for determining the force applied to said striking pad by a pannist;

a central processing chip for electronically controlling the functions of said steelpan drum, said processing chip mounted on a circuit board enclosed within said housing;

one or more memory chips mounted on said circuit board and coupled to said central processing chip for storing a variety of synthesized steelpan sounds and a full range of musical, orchestral, and symphonic sounds to be reproduced by said steelpan drum;

a plurality of function selection buttons mounted on said control function surface of said housing for selecting one of said variety of synthesized steelpan sounds;

audio drivers mounted on said circuit board, the input of said audio drivers coupled to an audio output of said central processing chip;

volume control equalizing circuitry coupled to the output of said audio drivers;

one or more speakers mounted on said outer housing, said speakers driven from said audio drivers;

a CD burner/player port coupled to said central processing chip for mixing other musical, orchestral, and symphonic sounds with the steelpan drum sound and for recording the output from said steelpan drum;

a display mounted on said outer housing for use in plug-and-play setup and controlling the basic elements of said steelpan drum, said basic elements of said steelpan drum being selected from the group consisting of: sound type, configuration of striking pads, tone, rhythm, melody, harmony, tone color, and equalized volume;

an audio output jack mounted on said outer housing for use with an external audio amplifier;

a musical instrument digital interface (MIDI) provided on said outer housing for interfacing said steelpan drum with other musical instruments;

a series of equalizing volume control buttons mounted on said outer housing for quick equalization of the sound from said steelpan drum by a musician; and a power supply for providing DC power to said circuit board of said steelpan drum, said power supply being sourced from a 110-volt AC outlet.

17. The steelpan drum of claim 16, wherein said synthesized steelpan sounds are from the group consisting of: tenor (soprano), double tenor, double seconds, double guitar, triple guitar, four-pan, (cello), quadraphonic, tenor bass, six bass, nine bass, and twelve bass.

18. The steelpan drum of claim 16, wherein said pansticks are made of hard rubber-type material.

* * * * *